US008778467B2

(12) United States Patent
Asao et al.

(10) Patent No.: US 8,778,467 B2
(45) Date of Patent: Jul. 15, 2014

(54) RECORDING MEDIUM

(75) Inventors: Masaya Asao, Yokohama (JP); Takeshi Tsurusaki, Funabashi (JP); Arika Tanaka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/539,844

(22) Filed: Jul. 2, 2012

(65) Prior Publication Data

US 2013/0011584 A1 Jan. 10, 2013

(30) Foreign Application Priority Data

Jul. 5, 2011 (JP) ..... 2011-149275
Jul. 5, 2011 (JP) ..... 2011-149362

(51) Int. Cl.
*B41M 5/40* (2006.01)
*B41M 5/52* (2006.01)

(52) U.S. Cl.
CPC ..... *B41M 5/5218* (2013.01); *B41M 5/52* (2013.01); *B41M 5/5254* (2013.01)
USPC ..... 428/32.34; 428/32.36

(58) Field of Classification Search
CPC ..... B41M 5/5218; B41M 5/52; B41M 5/254
USPC ..... 428/32.34, 32.36
See application file for complete search history.

(56) References Cited

U.S. PATENT DOCUMENTS

| | | | | |
|---|---|---|---|---|
| 5,372,884 | A * | 12/1994 | Abe et al. | 428/32.36 |
| 5,965,252 | A * | 10/1999 | Santo et al. | 428/32.36 |
| 6,645,582 | B2 * | 11/2003 | Sadasivan et al. | 428/32.34 |
| 6,984,423 | B2 * | 1/2006 | Iida et al. | 428/32.17 |
| 2001/0018155 | A1 | 8/2001 | Tashiro | |
| 2006/0187293 | A1 | 8/2006 | Thomas | |
| 2007/0196597 | A1 * | 8/2007 | Shiratsuchi et al. | 428/32.34 |
| 2009/0233016 | A1 | 9/2009 | Furholz et al. | |
| 2010/0279035 | A1 * | 11/2010 | Namba et al. | 428/32.21 |
| 2013/0011584 | A1 * | 1/2013 | Asao et al. | 428/32.1 |

FOREIGN PATENT DOCUMENTS

| | | | |
|---|---|---|---|
| CN | 101905582 | A | 12/2010 |
| JP | 2008-254432 | A | 10/2003 |
| JP | 2003305942 | A | 10/2003 |
| JP | 2008-254430 | A | 10/2008 |

* cited by examiner

*Primary Examiner* — Betelhem Shewareged
(74) *Attorney, Agent, or Firm* — Canon U.S.A., Inc., IP Division

(57) ABSTRACT

Provided is a recording medium including an ink-receiving layer containing an inorganic pigment and a binder on at least one surface of a substrate. The ink-receiving layer contains a compound including zirconium, silicon, and at least one element selected from Group 2 and Group 3 elements of the periodic table.

14 Claims, 1 Drawing Sheet

RECORDING MEDIUM

BACKGROUND OF THE INVENTION

1. Field of the Invention

The present invention relates to a recording medium.

2. Description of the Related Art

Recording media are required to have various physical properties such as fixing properties of ink, clearness of images, and ozone resistance. Japanese Patent Laid-Open No. 2008-254430 proposes a technology relating to a recording medium containing a composite compound prepared by a reaction of a silane coupling agent having an amino group and a zirconium compound and thereby reducing blurring in an image stored under a high temperature and high humidity environment as well as enhancing ozone resistance of the image.

SUMMARY OF THE INVENTION

Accordingly, aspects of the present invention provide a recording medium that can impart high ozone resistance to images and also effectively prevent occurrence of blurring in images stored under a high temperature and high humidity environment.

The present invention relates to a recording medium having an ink-receiving layer containing an inorganic pigment and a binder on at least one surface of a substrate. The ink-receiving layer contains a compound containing zirconium, silicon, and at least one element selected from Group 2 and Group 3 elements of the periodic table.

Aspects of the present invention can provide a recording medium that can impart high ozone resistance to images and also effectively prevent occurrence of blurring in images stored under a high temperature and high humidity environment.

Further features of the present invention will become apparent from the following description of exemplary embodiments with reference to the attached drawings.

DESCRIPTION OF THE EMBODIMENTS

According to the results of inspection by the present inventors, in the recording medium described in Japanese Patent Laid-Open No. 2008-254430, unfortunately, the ozone resistance of images is low, and blurring occurs in images stored under a high temperature and high humidity environment.

Recording Medium

Figure 1:
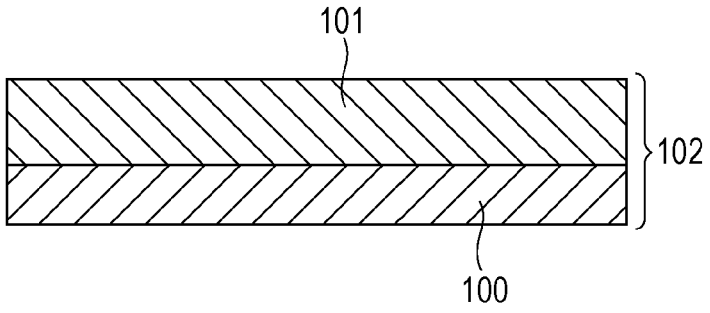
FIG. 1 is a cross-sectional view schematically illustrating an example of a recording medium according to the present invention.

An embodiment of the present invention will now be described with reference to the drawings. FIG. 1 is a cross-sectional view schematically illustrating an example of a recording medium according to the present invention and shows an ink-jet recording medium (102) having a structure including an ink-receiving layer (101) on one surface of a substrate (100). The ink-receiving layer may be provided on each surface of the substrate. The ink-receiving layer (101) includes an inorganic pigment, a binder, and a compound containing zirconium, silicon, and at least one element selected from Group 2 and Group 3 elements of the periodic table (hereinafter, the compound is also referred to as "composite compound"). Throughout the specification, at least one element selected from Group 2 and Group 3 elements of the periodic table is also referred to as a Group 2 or Group 3 element, and a compound containing at least one element selected from Group 2 and Group 3 elements of the periodic table is also referred to as a Group 2 or Group 3 element compound.

The development of the present invention and a presumed mechanism that the recording medium of the present invention can impart high ozone resistance to images and also effectively prevent occurrence of blurring in images stored under a high temperature and high humidity environment will now be described. As a result of the investigation, the present inventors have found that a recording medium having an ink-receiving layer that contains a composite compound including zirconium, silicon, and a Group 2 and 3 element compound shows excellent ozone resistance. This is probably caused by that the Group 2 and 3 element compound adheres to the acid point on the surface of a particle of an inorganic pigment such as alumina hydrate or silica to decrease the strength of the acid point and, thereby, generation of a radical, which is generated when ozone comes into contact with an acid point, can be prevented.

However, it also has been found that a recording medium containing a Group 2 or Group 3 element compound tends to cause blurring in images stored under a high temperature and high humidity environment. The aqueous solvent for dispersing an inorganic pigment such as alumina hydrate or silica is usually an acid aqueous solution, and an ink-receiving layer is formed by application of such an acid aqueous solution containing an inorganic pigment. If such an acid aqueous solution or an ink-receiving layer formed with such an acid aqueous solution contains a Group 2 or Group 3 element compound, the Group 2 or Group 3 element ionizes to form a salt with a negative ion come from an acidic compound. Consequently, the ink-receiving layer contains the salt of the Group 2 or Group 3 element. Such a salt tends to deliquesce under a high temperature and high humidity environment to readily cause blurring.

In the present invention, the Group 2 or Group 3 element constitutes a part of a composite compound containing zirconium and silica. That is, the Group 2 or Group 3 element is incorporated inside the structure of the composite compound. Consequently, the ionization of the Group 2 or Group 3 element can be prevented, and the Group 2 or Group 3 element is prevented from generating a salt thereof when it comes into contact with an acid aqueous solution, resulting in prevention of blurring in images stored under a high temperature and high humidity environment. Each constituent material of the recording medium according to the present invention will now be described in more detail.

Ink-Receiving Layer

The recording medium of the present invention includes an ink-receiving layer on at least one surface of a substrate. The ink-receiving layer contains an inorganic pigment, a binder, and a compound containing zirconium, silicon, and at least one element selected from Group 2 and Group 3 elements of the periodic table. Materials that can be used in the ink-receiving layer of the present invention will now be described.

Compound Containing Zirconium, Silicon, and at Least One Element Selected from Group 2 and Group 3 Elements of the Periodic Table The compound containing zirconium, silicon, and at least one element selected from Group 2 and Group 3 elements of the periodic table may be produced by any method and can be produced by, for example, a wet process. A specific example of producing the compound by the wet process will be described. A Group 2 or Group 3 element compound and a zirconium compound are added to a liquid solvent, and a silane coupling agent is gradually added thereto while stirring with, for example, a homomixer, an agitator, a ball mill, or an ultrasonic disperser. The liquid solvent may be at least either water or alcohol (e.g., methanol, ethanol, or butanol) or may be a mixture of water and alcohol. Subsequently, a silane oligomer is formed by hydrolysis and condensation reaction of the silane coupling agent. The silane oligomer is formed while incorporating the Group 2 or Group 3 element and zirconium therein to give a suspension containing a composite compound. On this occasion, in order to form a uniform composite compound, stirring may be performed. The proceedings of the hydrolysis and condensation reaction of the silane coupling agent can be optionally controlled by adjusting the pH of the system by adding, for example, an organic acid. Though the hydrolysis and condensation reaction of the silane coupling agent proceed even at ordinary temperature, the reaction system may be heated for allowing each reaction to efficiently proceed. Optimum reaction temperature varies depending on the type of the silane coupling agent, but is usually 20° C. to 100° C.

A specific example of a method of producing the composite compound will be described. N-2-(Aminoethyl)-3-aminopropyltriethoxysilane is added to an aqueous solution containing magnesium chloride hexahydrate and zirconium oxyacetate. Subsequently, the silane coupling agent is hydrolyzed, and the hydrolysate is heated for dehydration-condensation to give a composite compound wherein magnesium and zirconium are incorporated in the structure of a silane oligomer.

A presumed mechanism of forming the compound containing a Group 2 or Group 3 element, zirconium, and silicon by the method described above will be described. The silane coupling agent is hydrolyzed in water or alcohol to generate silanol (—Si—OH). The generated silanol molecules gradually condense with each other to form siloxane bonds (—Si—O—Si—) and ultimately form a silane oligomer. In a system where the silane coupling agent having such characteristics coexists with a Group 2 or Group 3 element compound and zirconium compound, hydrolysis and condensation reaction proceed in the presence of the Group 2 or Group 3 element and zirconium in the system. As a result, a siloxane bond via a Group 2 or Group 3 element or zirconium, such as —Si—O—Mg—O—Si— or —Si—O—Zr—O—Si—, is formed to give a compound containing the Group 2 or Group 3 element, zirconium, and silicon.

A method of producing a composite compound according to the present invention includes a precursor-forming step of forming a composite precursor of one of a compound containing at least one element selected from Group 2 and Group 3 elements of the periodic table and a zirconium compound with a silane coupling agent in a liquid solvent containing water and/or alcohol; and a composite compound-forming step of forming a composite compound of the other of the compound containing at least one element selected from Group 2 and Group 3 elements of the periodic table and the zirconium compound with the resulting precursor. That is, two embodiments can be included in the method of producing a composite compound according to the present invention: a method of producing a composite compound by forming a composite precursor of a compound containing at least one element selected from Group 2 and Group 3 elements of the periodic table with a silane coupling agent in a liquid solvent containing water and/or alcohol and then further forming a composite compound of the resulting composite precursor with a zirconium compound in a liquid solvent containing water and/or alcohol; and a method of producing a composite compound by forming a composite precursor of a zirconium compound with a silane coupling agent in a liquid solvent containing water and/or alcohol and then further forming a composite compound of the resulting composite precursor with a compound containing at least one element selected from Group 2 and Group 3 elements of the periodic table in a liquid solvent containing water and/or alcohol. As described above, though the hydrolysis and condensation reaction of the silane coupling agent proceed even at ordinary temperature, the reaction system may be heated for allowing each reaction to efficiently proceed. Optimum reaction temperature varies depending on the type of the silane coupling agent, but the reaction temperature is usually 20° C. to 100° C.

This method can provide not only high ozone resistance but also high light resistance. Though the mechanism of improving light resistance is unclear, the present inventors presume as follows: In the case where materials for producing a composite compound are added in a specific order as in the method described above, a composite compound including a block in which the rates of a Group 2 or Group 3 element and silicon are high and a block in which the rates of zirconium and silicon are high can be produced. The composite compound including a block in which the rates of a Group 2 or Group 3 element and silicon are high and a block in which the rates of zirconium and silicon are high is superior to a composite compound including a Group 2 or Group 3 element, zirconium, and silicon at a constant rate in aggregation of a color material, in particular, a dye, and thereby probably increases the light resistance.

The mechanism of providing a composite compound including a block in which the rates of a Group 2 or Group 3 element and silicon are high and a block in which the rates of zirconium and silicon are high will now be described. The coexistence of a silane coupling agent with a Group 2 and 3 element compound forms a siloxane bond via the Group 2 or Group 3 element, such as —Si—O-M-O—Si— (M represents the Group 2 or Group 3 element), to provide a composite compound precursor containing a Group 2 or Group 3 element and silicon. Subsequently, a zirconium compound is added to the reaction system. Zirconium in the zirconium compound is incorporated into the precursor while forming a siloxane bond via zirconium, such as —Si—O—Zr—O—Si—. As a result, provided is a composite compound having a portion where a large number of siloxane bonds via the Group 2 or Group 3 element are present, i.e., a block where the rates of the Group 2 or Group 3 element and silicon are high, and a portion where a large number of siloxane bonds via zirconium are present, i.e., a block where the rates of zirconium and silicon are high. Alternatively, the coexistence of a silane coupling agent with a zirconium compound forms a siloxane bond via the zirconium to provide a composite compound precursor containing zirconium and silicon. Subsequently, a Group 2 or Group 3 element compound is added to the reaction system. The Group 2 or Group 3 element in the Group 2 or Group 3 element compound is incorporated into the precursor while forming a siloxane bond via the Group 2 or Group 3 element. As a result, a composite compound including a block where the rates of the Group 2 or Group 3 element and silicon are high and a block where the rates of zirconium and silicon are high can be prepared.

It can be confirmed that the composite compound produced by the method described above contains the Group 2 or Group 3 element and zirconium through analysis of the composite compound by an X-ray diffraction (XRD) method. In the XRD chart of a composite compound, the X-ray diffraction peaks of the Group 2 or Group 3 element compound and the zirconium compound used as the raw materials disappear, and a new X-ray diffraction peak of the composite compound having an amorphous structure containing the Group 2 or Group 3 element, zirconium, and silicon can be confirmed. In the present invention, when an X-ray diffraction peak of the composite compound having an amorphous structure containing the Group 2 or Group 3 element, zirconium, and silicon is confirmed, it is judged that a composite compound having a —Si—O-M-O—Si— structure (M represents the Group 2 or Group 3 element) and a —Si—O—Zr—O—Si— structure has been prepared. When a recording medium is prepared, whether the ink-receiving layer includes a composite compound containing a Group 2 or Group 3 element, zirconium, and silicon or not can be determined by analyzing the recording medium through element mapping with a transmission electron microscope (TEM).

The content of the composite compound in an ink-receiving layer can be 0.1% by mass or more and 30% by mass or less, in particular, 1% by mass or more and 25% by mass or less, and further 3% by mass or more and 20% by mass or less based on the total mass of the inorganic pigment.

Materials that can be used in the method described above will now be described in detail.

Compound Containing at Least One Element Selected from Group 2 and Group 3 Elements of the Periodic Table In the present invention, "at least one element selected from Group 2 and Group 3 elements of the periodic table" refers to an element or elements belonging to Group 2 or Group 3 of the periodic table. In particular, the Group 2 or Group 3 element can be at least one selected from Mg, Ca, Sr, Y, La, and Ce.

Examples of the Group 2 or Group 3 element compound include salts composed of a Group 2 or Group 3 element ion and an organic acid ion or an inorganic acid ion, hydrates of the salts, and oxides of Group 2 and 3 elements. Specific examples of the organic acid ion include acetate ions and oxalate ions. Specific examples of the inorganic acid ion include sulfate ions, nitrate ions, carbonate ions, halogen ions, and hydroxy ions.

Specific examples of the Group 2 or Group 3 element compound include magnesium acetate tetrahydrate, calcium acetate monohydrate, strontium acetate hemihydrate, calcium chloride, calcium formate, calcium sulfate, magnesium sulfate, magnesium chloride hexahydrate, magnesium citrate nonahydrate, strontium nitrate, yttrium acetate n-hydrate, yttrium chloride hexahydrate, yttrium nitrate hexahydrate, lanthanum nitrate hexahydrate, lanthanum chloride heptahydrate, lanthanum acetate 1.5-hydrate, lanthanum benzoate, cerium chloride heptahydrate, cerium sulfate tetrahydrate, cerium octylate, calcium hydroxide, magnesium hydroxide, magnesium oxide, yttrium oxide, lanthanum oxide, and cerium oxide. The composite compound of the present invention may contain a plurality of Group 2 or Group 3 elements.

The number of atoms of the Group 2 or Group 3 element of the periodic table contained in the composite compound can be 0.001 times or more and 0.03 times or less the number of atoms of the metal element constituting the inorganic pigment, in particular, 0.001 times or more and 0.02 times or less the number of atoms of the metal element. When the ratio of the number of the atoms is not less than 0.001, excellent ozone resistance can be obtained. When the ratio of the number of the atoms is not higher than 0.03, occurrence of blurring in images stored under a high temperature and high humidity environment can be effectively prevented. In the present invention, the ratio of the number of the atoms in the ink-receiving layer can be calculated by inductively coupled plasma emission spectrometry (ICP-OES). When the ink-receiving layer contains a plurality of types of inorganic pigments and Group 2 or Group 3 elements, the ratio of the number of the atoms can be calculated using the total number of these elements.

The number of atoms of the Group 2 or Group 3 element of the periodic table contained in the composite compound can be 0.1 times or more and 5 times or less the number of the silicon atoms contained in the composite compound, in particular, 0.5 times or more and 2 times or less the number of the silicon atoms.

Zirconium Compound

The zirconium compound may be any compound containing zirconium in the structure thereof and can be at least one selected from halide salts of zirconium, oxoacid salts of zirconium, and organic acid salts of zirconium.

Specific examples of the halide salts of zirconium include $ZrOCl_2.8H_2O$, $Zr_2O_3Cl_2$, $ZrCl_4$, $ZrCl_3$, $ZrCl_2$, $ZrBr_4$, $ZrBr_3$, $ZrBr_2$, $ZrI_4$, $ZrI_3$, $ZrI_2$, $ZrF_4$, $ZrF_3$, and $ZrF_2$. Specific examples of the oxoacid salts of zirconium include $Zr(NO_3)_4.2H_2O$, $ZrO(NO_3)_2.2H_2O$, $Zr(SO_4)_2$, $Zr(SO_4)_2.4H_2O$, $ZrO(SO_4)$, $Zr(H_2PO_4)_2$, $ZrP_2O_7$, $ZrSiO_4$, $(NH_4)ZrO(CO_3)_2$, $ZrO(CO_3)_2.nH_2O$, and $ZrO(OH)_2.nH_2O$. Specific examples of the organic acid salts of zirconium include zirconium acetate, zirconyl lactate, zirconyl stearate, zirconyl octylate, zirconyl laurylate, and zirconyl mandelate.

Among the zirconium compounds mentioned above, those having high solubility in water and being easily hydrolyzed, for example, oxoacid salts of zirconium, can be particularly used. The oxoacid salts of zirconium include ZrO units in the structure thereof, and such a structure contributes to higher solubility in water and easier hydrolysis compared with other zirconium compounds. The zirconium compounds may be used alone or in combination thereof.

The number of the zirconium atoms contained in the composite compound can be 0.001 times or more and 0.05 times or less the number of the metal atoms constituting the inorganic pigment, in particular, 0.001 times or more and 0.03 times or less the number of the metal atoms. When the number ratio of the atoms is not less than 0.001, occurrence of blurring in images stored under a high temperature and high humidity environment can be effectively prevented. When the number ratio of the atoms is not higher than 0.05, appropriate ink absorbability can be obtained. The number ratio (C/A) of the atoms in the ink-receiving layer can be calculated by inductively coupled plasma emission spectrometry (ICP-OES).

The number of the zirconium atoms contained in the composite compound can be 0.1 times or more and 5 times or less the number of the silicon atoms, in particular, 0.2 times or more and 3 times or less, further 0.5 times or more and twice or less the number of the silicon atoms.

Silane Coupling Agent

The silane coupling agent generally has a structure represented by the following Formula (1):

$$R_pSiX_{4-p} \qquad \text{Formula (1):}$$

(wherein, R represents a hydrocarbon group; X represents a hydrolysable group; p represents an integer of 1 to 3; and when p is 2 or 3, Rs may be the same as or different from each other).

Examples of R in Formula (1) include alkyl groups, alkenyl groups, and aryl groups. R may have a substituent. Examples of the substituent include alkyl groups, alkenyl groups, aryl groups, alkynyl groups, aralkyl groups, amino groups, diamino groups, epoxy groups, mercapto groups, glycidoxy groups, methacryloxy groups, ureide groups, chloro groups, cyano groups, isocyanate groups, and vinyl groups. The number of carbon atoms of R can be from 2 to 10. When the number of carbon atoms is two or more, sufficient hydrophobicity can be easily provided. When the number of carbon atoms is ten or less, a decrease in dispersibility of a composite compound in water due to an increase in hydrophobicity can be prevented, and adhesiveness to an inorganic pigment is enhanced. Examples of X include alkoxyl groups, alkoxyalkoxyl groups, halogens, and acyloxy groups, more specifically, methoxy groups, ethoxy groups, and chloro groups.

Specific examples of the silane coupling agent include dialkoxysilane compounds such as methyltrimethoxysilane, methyltriethoxysilane, methyltrichlorosilane, vinyltrichlorosilane, vinyltriacetoxysilane, vinyl tris(β-methoxyethoxy) silane, vinyltriethoxysilane, vinyltrimethoxysilane, γ-methacryloxypropyltrimethoxysilane, γ-methacryloxypropylmethyldimethoxysilane, β-(3,4-epoxycyclohexyl)ethyltrimethoxysilane, γ-glycidoxypropyltrimethoxysilane, γ-glycidoxypropylmethyldiethoxysilane, N-β-(aminoethyl)-γ-aminopropyltrimethoxysilane, N-β-(aminoethyl)-γ-aminopropylmethyldimethoxysilane, γ-aminopropyltriethoxysilane, N-phenyl-γ-aminopropyltrimethoxysilane, γ-mercaptopropyltrimethoxysilane, γ-mercaptopropylmethyldimethoxysilane, γ-chloropropyltrimethoxysilane, γ-chloropropylmethyldichlorosilane, γ-chloropropylmethyldimethoxysilane, γ-chloropropylmethyldiethoxysilane, γ-ureidopropyltriethoxysilane, γ-anilinopropyltrimethoxysilane, and octadecyldimethyl[3-(trimethoxysilyl)propyl]ammonium chloride; diacyloxysilane compounds; trialkoxysilane compounds; triacyloxysilane compounds; triphenoxysilane compounds; and hydrolysates thereof. These silane coupling agents may be used alone or in combination thereof.

The additive amount of the silane coupling agent varies depending on various physical properties of the organic pigment and the type of the silane coupling agent and can be appropriately adjusted. The additive amount of the silane coupling agent can be 0.1% by mass or more and 10% by mass or less, in particular, 0.5% by mass or more and 5% by mass or less, based on 100% by mass of the inorganic pigment. An amount of 0.1% by mass or more can effectively prevent occurrence of blurring in images stored under a high temperature and high humidity environment. An amount of 10% by mass or less can impart hydrophilicity to the ink-receiving layer and can thereby provide appropriate ink absorbability.

Inorganic Pigment

Any inorganic pigment can be used in the present invention, and examples thereof include alumina hydrate, alumina, silica, colloidal silica, titanium dioxide, zeolite, kaolin, talc, hydrotalcite, zinc oxide, zinc hydroxide, aluminum silicate, calcium silicate, magnesium silicate, zirconium oxide, and zirconium hydroxide. In particular, alumina hydrate and silica form good porous structures and have high ink absorbability, and are thereby excellent inorganic pigments. These inorganic pigments may be used alone or in combination thereof. That is, at least one selected from alumina hydrate and silica can be used as an inorganic pigment.

The inorganic pigment can have an average primary particle diameter of 1 nm or more and 1 μm or less, particularly, 50 nm or less. In particular, in order to form a porous structure showing good ink absorbability, silica fine particles or alumina hydrate fine particles having an average primary particle diameter of 20 nm or less can be used. The average primary particle diameter of an inorganic pigment is the number-average diameter of circles having areas equal to the areas of projected images of primary particles when the inorganic pigment is observed with an electron microscope. In the observation, at least 100 particles are measured.

The content of the inorganic pigment in the ink-receiving layer can be 70% by mass or more and 95% by mass or less in terms of solid content. A content of 70% by mass or more can provide appropriate ink absorbability and can prevent a beading phenomenon in printing with an ink-jet printer. A content of 95% by mass or less can impart appropriate strength to the ink-receiving layer and can prevent occurrence of cracking.

Alumina hydrate as the inorganic pigment can be represented by, for example, the following Formula (2):

$$Al_2O_{3-n}(OH)_{2n}.mH_2O \quad (2).$$

In Formula (2), n is 0, 1, 2, or 3; m is a number of 0 or more and 10 or less, in particular, 0 or more and 5 or less; and m and n are not simultaneously 0. In many cases, $mH_2O$ represents an eliminable aqueous phase, which does not participate in the formation of crystal lattice, and m can be therefore an integer or a numerical value other than an integer. When this type of a material (alumina hydrate) is heated, m can become 0 in some cases.

The alumina hydrate can be produced by a known method. An example of the method is hydrolysis of aluminum alkoxide or sodium aluminate (see U.S. Pat. Nos. 4,242,271 and 4,202,870). Another example of the method is neutralization of an aqueous solution of sodium aluminate with an aqueous solution of, for example, aluminum sulfate or aluminum chloride. The alumina hydrate in the present invention can show alumina hydrate structure or amorphous structure in X-ray diffraction analysis.

The pore volume of the alumina hydrate can be 0.3 mL/g or more and 1.0 mL/g or less, in particular, 0.35 mL/g or more and 0.9 mL/g or less. In addition, the alumina hydrate can have a BET specific surface area of 50 $m^2/g$ or more and 350 $m^2/g$ or less, in particular, 100 $m^2/g$ or more and 250 $m^2/g$ or less, when measured by a BET method. The BET method is used for measuring surface areas of powder by gas phase adsorption and for determining total surface area of one gram of a sample, i.e., specific surface area, from an adsorption isotherm. Usually, nitrogen gas is used as the gas to be adsorbed, and, in most cases, the adsorbed amount of the gas is measured from the change in pressure or volume of the adsorbed gas. The equation of Brunauer-Emmett-Teller, called a BET equation, is the most famous equation that indicates a multimolecular adsorption isotherm and is widely used in specific surface area determination. The specific surface area is determined by multiplying the amount of adsorbed gas determined by the BET equation by the area occupied by one adsorbed molecule on a surface. In the BET method, a relationship of the amount of adsorbed gas and relative pressure is measured by a nitrogen adsorption-desorption method at several points to calculate the slope and intercept of the plots by a least squares method, and the specific surface area is thereby derived. In order to increase the accuracy of the measurement, the relationship between the relative pressure and the amount of adsorbed gas is determined by measuring at least five different points, in particular, 10 points or more.

Generally, the method of producing silica that can be used as the inorganic pigment of the present invention is roughly classified into a wet method and a dry method (gas phase method). In the wet method, active silica is generated by acidolysis of silicate, and the active silica is appropriately polymerized to obtain hydrous silica through coagulation sedimentation. In the dry method, anhydrous silica is obtained by high-temperature gas-phase hydrolysis (flame hydrolysis process) of a silicon halide or by a method (arc method) in which silica sand and cokes are heated, reduced, and vapored by arc in an electrical furnace and the resulting product is oxidized in air. The silica obtained by the gas phase method, i.e., gas phase method silica, has a particularly large specific surface area and therefore has high ink absorbability and high efficiency of ink retention. In addition, the gas phase method silica has a low refractive index and can therefore impart transparency to an ink-receiving layer to give high color concentration and high color developability. The specific surface area of the gas phase method silica measured by the BET method can be 90 $m^2/g$ or more and 400 $m^2/g$ or less.

In the present invention, the inorganic pigment can be subjected to surface treatment with the composite compound described above. In the surface-treated inorganic pigment, the acid point on the inorganic pigment surface is masked with the composite compound to provide high ozone resistance. Examples of the surface treatment include a method where a dispersion of a composite compound and an inorganic pigment in a solvent such as water is heat-dried in an oven or is spray-dried with a spray dryer. The method of spray drying with a spray dryer can uniformly apply the composite compound onto the inorganic pigment surface. The heating temperature for drying can be from 100° C. to 400° C. Since a temperature of higher than 400° C. converts the alumina hydrate phase to an α-alumina phase, the heating temperature is usually 400° C. or less.

Whether the pigment surface is treated with the composite compound of the present invention or not can be confirmed by X-ray photoelectron spectroscopy (XPS). Specifically, for example, in the case of using alumina hydrate as the inorganic pigment, the position of peak in a 2p orbital spectrum or a 2s orbital spectrum of an aluminum atom measured by XPS is investigated. The peak position in the spectrum of the inorganic pigment surface-treated with the composite compound chemically shifts to the lower energy side compared with that in the spectrum of the alumina hydrate not subjected to surface treatment. Accordingly, when a chemical shift to the lower energy side of a peak position is confirmed after surface treatment of an inorganic pigment, the inorganic pigment can be judged to be surface-treated with such a composite compound.

Binder

The binder used in the ink-receiving layer of the present invention can be a water-soluble polymer. Examples of the binder include polyvinyl alcohol and modified products thereof; starch and modified products thereof; gelatin and modified products thereof; natural polymeric resins such as casein, pullulan, gum arabic, karaya gum, and albumin, and derivatives thereof; latex such as cation-modified latex, SBR latex, NBR latex, methyl methacrylate-butadiene copolymers, and ethylene-vinyl acetate copolymers; vinyl polymers such as polyacrylamide and polyvinyl pyrrolidone; polyethyleneimine; polypropylene glycol; polyethylene glycol; and maleic anhydride and copolymers thereof. These binders can be used alone or in combination thereof.

Among the binders mentioned above, polyvinyl alcohol and modified products thereof can be particularly used. Examples of the modified products of polyvinyl alcohol include polyvinyl alcohol derivatives such as cation-modified polyvinyl alcohol, anion-modified polyvinyl alcohol, silanol-modified polyvinyl alcohol, and polyvinyl acetal.

In the present invention, the content of the inorganic pigment in the ink-receiving layer can be 5 times or more and 30 times or less the content of the binder in terms of mass ratio. Within this mass ratio, haze can be particularly prevented, high optical density and glossiness can be obtained, and the ink-receiving layer can have appropriate strength.

Other Materials

In order to uniformly disperse the inorganic pigment in a solvent such as water, a deflocculating agent may be added to a coating solution for forming an ink-receiving layer, and an ink-receiving layer containing such a deflocculating agent can be formed using the coating solution. For example, in the case of using alumina hydrate as the inorganic pigment, a dispersion in which the alumina hydrate is uniformly dispersed can be obtained using an acid as the deflocculating agent. The acid serving as the deflocculating agent is generally known, and examples thereof include organic acids such as acetic acid, formic acid, oxalic acid, alkylsulfonic acids (e.g., methanesulfonic acid, ethanesulfonic acid, butanesulfonic acid, and isopropanesulfonic acid); and inorganic acids such as nitric acid, hydrochloric acid, and sulfuric acid.

The coating solution for forming an ink-receiving layer can optionally contain a cationic polymer. In particular, in the case of using silica as the inorganic pigment, the coating solution can contain a cationic polymer for increasing water resistance. Examples of the cationic polymer include quaternary ammonium salts, polyamine, alkylamine, halogenated quaternary ammonium salts, cationic urethane resins, amine-epichlorohydrin polyaddition products, dihalide-diamine polyaddition products, polyamidine, vinyl (co)polymers, polydiallyldimethylammonium chloride, polymethacryloyloxyethyl-β-hydroxyethyldimethylammonium chloride, polyethyleneimine, polyacrylamine and derivatives thereof, polyamide-polyamine resins, cationized starch, dicyandiamide formalin condensates, dimethyl-2-hydroxypropylammonium salt polymers, polyamidine, polyvinylamine, dicyan cationic resins, polyamine cationic resins, epichlorohydrin-dimethylamine addition polymers, dimethyldiallylammonium chloride-$SO_2$ copolymers, diallylamine salt-$SO_2$ copolymers, polymers containing (meth)acrylate having a quaternary ammonium salt-substituted alkyl group at the ester moiety, styryl-type polymers having a quaternary ammonium salt-substituted alkyl group, polyamide resins, polyamide-epichlorohydrin resins, and polyamide-polyamine-epichlorohydrin resins.

The ink-receiving layer of the recording medium of the present invention can contain one or more boric acid compounds as a crosslinking agent. Examples of the boric acid compound include orthoboric acid ($H_3BO_3$), metaboric acid, hypoboric acid, and boric acid salts. The boric acid salts can be water-soluble salts of the above-mentioned boric acids. Specific examples of the boric acid salts include alkali metal salts such as sodium salts of boric acids (e.g., $Na_2B_4O_7.10H_2O$ and $NaBO_2.4H_2O$) and potassium salts of boric acids (e.g., $K_2B_4O_7.5H_2O$ and $KBO_2$); and ammonium salts of boric acids (e.g., $NH_4B_4O_9.3H_2O$ and $NH_4BO_2$). From the viewpoints of long-term stability and prevention of occurrence of cracking, orthoboric acid may be used. The content of the boric acid compound may be appropriately adjusted depending on, for example, production conditions. For example, the content of the boric acid compound can be 1.0% by mass or more and 15.0% by mass or less based on 100% by mass of the binder from the viewpoint of preventing cracking. In addition, a content of 15.0% by mass or less can provide a coating solution showing satisfactory long-term stability. In general, the coating solution is used over a long time when a recording medium is produced. Even in such a case, a content of the boric acid compound of 15.0% by mass or less is not too high and can avoid an increase in viscosity or gelation of the coating solution. Accordingly, the number of times of displacement of the coating solution and cleaning of the coater head can be reduced, and thereby the productivity is further improved.

In the present invention, the ink-receiving layer may further contain other additives. Examples of such additives include thickeners, pH adjusters, lubricants, liquidity modifiers, surfactants, antifoaming agents, water resistant additives, foam suppressors, mold-releasing agents, foaming agents, penetrating agents, coloring dyes, fluorescent brightening agents, UV absorbers, antioxidants, antiseptic agents, and antifungal agents.

Substrate

Examples of the substrate of the recording medium of the present invention include appropriately sized paper, unsized paper, resin coated paper coated with, e.g., polyethylene, sheet-like materials such as thermoplastic films, and fabric. The thermoplastic film may be a transparent film of, for example, polyester, polystyrene, polyvinyl chloride, polymethyl methacrylate, cellulose acetate, polyethylene, or polycarbonate. A sheet opacified by filling with inorganic particles or fine foaming can also be used.

The substrate of the recording medium of the present invention can be paper produced from a fibrous material. The fibrous material can be, for example, cellulose pulp. Specific examples of the cellulose pulp include sulfite pulp (SP) prepared from broadleaf wood or coniferous wood, chemical pulp such as alkali pulp (AP) and kraft pulp (KP), semichemical pulp, semimechanical pulp, mechanical pulp, and recycled pulp as deinked secondary fiber. These may be used alone or in combination thereof.

The pulp may be unbleached pulp or bleached pulp and may be beaten pulp or unbeaten pulp. Examples of the beaten cellulose pulp include no wood pulp such as fiber of grass, leaves, bast, seed fiber, etc. and pulp of straw, bamboo, hemp, bagasse, esparto, kenaf, kozo, mitsumata, cotton linters, etc.

The substrate that is used in the present invention may be the above-mentioned cellulose pulp containing at least one selected from, for example, the group consisting of mechanical pulp such as bulky cellulose fiber, mercerized cellulose, fluffed cellulose, and thermomechanical pulp. The addition of such pulp can further enhance the ink-absorbing rate and ink-absorbing capacity of the resulting recording medium.

In addition, lightly beaten cellulose pulp may be used together with the above-mentioned cellulose pulp. In the present invention, the lightly beaten cellulose pulp is chemical pulp made from chips of wood and not sufficiently beaten. In the slightly beaten cellulose pulp, fibrils are hardly formed by beating treatment, and such cellulose pulp therefore has excellent absorbability and bulkiness. Examples of the lightly beaten cellulose pulp that can be used include those described in Japanese Patent Laid-Open No. 10-77595. The lightly beaten cellulose pulp can have a Canadian standard freeness of 550 mL or more.

In the substrate of the recording medium of the present invention, the above-mentioned cellulose pulp may contain, for example, the following pulp: fine fibrillated cellulose, crystallized cellulose, sulfate or sulfite pulp prepared from broadleaf wood or coniferous wood, soda pulp, hemicellulase-treated pulp, or enzyme-treated chemical pulp. The addition of such pulp provides effects of enhancing smoothness of the resulting recording medium surface and improving texture.

In the present invention, a filler can be optionally added to the fibrous material constituting the substrate. Examples of the filler include white pigments such as precipitated calcium carbonate and heavy calcium carbonate and silica-based materials such as silica, silicate, and silicate compounds.

The filler may have any shape such as a spherical, massive, or needle-like form. In order to particularly reduce interaction with fiber, a porous filler may be used. The filler can have a specific surface area of 50 $m^2/g$ or more. The content of the filler can be 5% by mass or more and 20% by mass or less based on the total mass of the substrate in terms of ash content. In a content of 5% by mass or more, a particularly high effect of preventing deformation of fiber can be provided. In a content of 20% by mass or less, an increase in amount of paper powder generation can be prevented. The ash content can be measured in accordance with JIS P8128. Furthermore, in the present invention, in order to particularly accelerate the ink-absorbing rate of the recording medium, the filler may not be added.

The substrate included in the recording medium of the present invention can be produced by mixing substrate materials and an optional porous filler mentioned above and performing papermaking. The basis weight of the substrate used in the present invention can be appropriately selected within the range not making the recording medium extremely thin because of a too low basis weight. For example, the basis weight can be 10 $g/m^2$ or more, in particular, 20 $g/m^2$ or more. A basis weight of 10 $g/m^2$ or more can impart adequate texture, bending strength, and tensile strength to the recording medium. The basis weight of the substrate can be 200 $g/m^2$ or less. A basis weight of 200 $g/m^2$ or less can impart adequate flexibility to the recording medium and prevents paper jamming in feeding of the recording medium by a printer.

Method of Producing Recording Medium

The recording medium of the present invention may be produced by any method and, for example, can be produced by any of the following two methods. One method of producing a recording medium includes a step of coating a substrate with a coating solution for an ink-receiving layer containing a composite compound, an inorganic pigment, and a binder. The other method of producing a recording medium includes a step of coating a substrate with a coating solution for an ink-receiving layer containing an inorganic pigment and a binder and, after the coating step, a step of adding a composite compound to the ink-receiving layer. The method of producing a recording medium will now be described in detail.

Method of Producing Substrate

The substrate in the recoding medium of the present invention can be produced by a method that is usually used for producing paper. Examples of the papermaking apparatus include Fourdrinier paper machines, cylinder-paper machines, drum papermaking machines, and twin-wire papermaking machines.

In the recording medium of the present invention, a porous material, such as precipitated calcium carbonate, heavy calcium carbonate, alumina, silica, silicate, or silicate, may be coated on a substrate by a size press process that is usually performed in production of paper. In this coating, a common coating process can be employed. Examples of such a process include a coating technology using a device such as a gate roll coater, size press, bar coater, blade coater, air-knife coater, roll coater, blush coater, curtain coater, gravure coater, or spray equipment. The resulting substrate can be subjected to calender treatment, thermocalender treatment, or super calender treatment to smoothen the surface thereof.

Method of Forming Ink-Receiving Layer

In the recording medium of the present invention, an ink-receiving layer can be produced on a substrate, for example, by the following method. A coating solution is prepared by mixing a composite compound, an inorganic pigment, a binder, and optional other additives. This coating solution is applied onto a substrate with a coating device and is dried. The composite compound and the inorganic pigment may be separately added to the coating solution. Alternatively, as described above, the inorganic pigment may be surface-treated with the composite compound and then be added to the coating solution.

Alternatively, instead of the method described above, the ink-receiving layer may be produced by applying a coating solution prepared by mixing an inorganic pigment, a binder, and optional other additives onto a substrate with a coating device, optionally drying the coating solution, then applying a coating solution containing at least a composite compound thereon, and drying the coating solution. The coating can be performed by, for example, using a device such as a blade coater, air-knife coater, roll coater, blush coater, curtain coater, bar coater, gravure coater, or spray equipment.

The application amount of the coating solution can be 5 $g/m^2$ or more and 45 $g/m^2$ or less in terms of dried solid content. In an application amount of 5 $g/m^2$ or more, good ink absorbability can be provided. In an application amount of 45 $g/m^2$ or less, occurrence of cockling can be particularly prevented. After the formation of the ink-receiving layer, the surface of the ink-receiving layer may be smoothened using, for example, a calender roll.

Examples

The present invention will now be more specifically described by examples, but is not limited to the following examples.

Examples 1 to 7 and Comparative Examples 1 to 5

Table 1 shows formulations of ink-jet recording media prepared in Examples 1 to 7 and Comparative Examples 1 to 5. In Table 1, Group 2 or Group 3 element compound, zirconium compound, and silane coupling agent are materials used for producing composite compounds. The metal compound added to the pigment dispersant shown in Table 1 is a metal compound added after production of the composite compound, and the elements contained in such a metal compound are not incorporated inside the composite compound.

Example 1

As a Group 2 or Group 3 element compound, 4.066 g of magnesium chloride hexahydrate was added to 14 g of deionized water, and subsequently, as a zirconium compound, 4.506 g of zirconium oxyacetate was added thereto, followed by stirring with a homomixer (T.K. Robomix, manufactured by Primix Corp.) to prepare an aqueous solution containing magnesium chloride hexahydrate and zirconium oxyacetate. Subsequently, as a silane coupling agent, 5.29 g of N-2-(aminoethyl)-3-aminopropyltriethoxysilane (trade name: KBE-603, manufactured by Shin-Etsu Chemical Co., Ltd.) was gradually added to the resulting aqueous solution. The silane coupling agent was hydrolyzed and condensed by stirring the resulting mixture for 5 hours to prepare a suspension of a composite compound containing magnesium, zirconium, and silicon.

A dispersion was prepared by adding 1.3 g of methanesulfonic acid and, as an inorganic pigment, 100 g of alumina hydrate (trade name: Disperal HP14, manufactured by Sasol) to 350 g of deionized water. To this dispersion, 7.241 g of the suspension containing the composite compound prepared above was added while stirring with a homomixer. Deionized water and methanesulfonic acid were further added to the resulting dispersion to prepare pigment dispersion 1 having a pH of 4.2 and a solid content of 20% by mass.

Separately, a PVA aqueous solution having a solid content of 8.0% by mass was prepared by dissolving, as a binder, polyvinyl alcohol PVA 235 (trade name, manufactured by Kuraray Co., Ltd., polymerization degree: 3500, saponification degree: 88%) in deionized water. The resulting PVA solution was mixed with pigment dispersion 1 prepared above so that the content of PVA was 10% by mass in terms of solid content based on the solid content (100% by mass) of alumina hydrate. Furthermore, an aqueous solution of 3.0% by mass of boric acid was added to the resulting solution so that the content of boric acid was 1.5% by mass in terms of solid content based on the solid content (100% by mass) of alumina hydrate to give a coating solution. The resulting coating solution was applied to one surface of a substrate, a polyethylene terephthalate (PET) film (trade name: Melinex 705, manufactured by Teijin DuPont Films Japan Limited) having a thickness of 100 μm, followed by drying at 110° C. to give an ink-jet recording medium having the ink-receiving layer containing the composite compound. The amount of the ink-receiving layer applied was 35 $g/m^2$ in the dried state. The number ratio (Mg/Al) of atoms of magnesium (Mg) to that of aluminum (Al) in the ink-receiving layer was 0.003 when measured by inductively coupled plasma emission spectrometry (ICP-OES). The number ratio (Mg/Si) of atoms of magnesium (Mg) to that of silicon (Si) and the number ratio (Zr/Si) of atoms of zirconium (Zr) to that of silicon (Si) in the composite compound were both 1 when measured by inductively coupled plasma emission spectrometry (ICP-OES).

Figure 2:
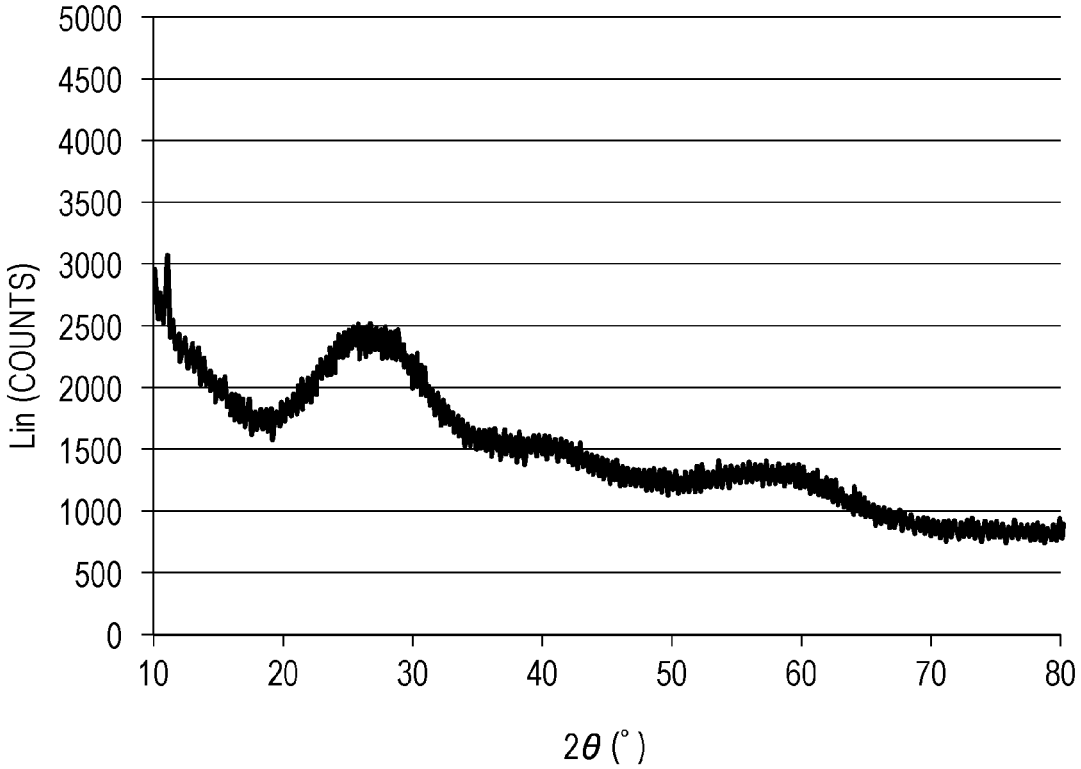
FIG. 2 is a diagram showing an X-ray diffraction (XRD) chart of an example of a composite compound according to the present invention.

A part of the suspension containing the composite compound that was prepared when the ink-jet recording medium was produced was dried at 110° C. The resulting solid was pulverized in a mortar to obtain powder containing the composite compound. The resulting powder was subjected to X-ray diffraction (XRD) measurement. The resulting XRD chart is shown in FIG. 2. The XRD measurement was performed with an X-ray diffraction apparatus (D8 ADVANCE, manufactured by Bruker AXS K.K.) using a Cu-Kα ray. The diffraction pattern was obtained by continuous scanning, i.e., taking data at $2\theta=10°$ to 80°, a sweep rate of 2°/min, and recording at each $2\theta=0.02°$. As obvious from FIG. 2, no diffraction peaks of a magnesium salt and a zirconium salt such as magnesium chloride hexahydrate and zirconium oxyacetate used as the raw materials were detected. Instead, broad peaks were observed at 27°, 40°, and 57°. This indicates that a composite compound having an amorphous structure containing magnesium, zirconium, and silicon therein, i.e., a composite compound having —Si—O—Mg—O—Si— structure and a —Si—O—Zr—O—Si— structure, was obtained.

Example 2

A suspension of a composite compound containing magnesium, zirconium, and silicon was produced as in Example 1. Separately, a dispersion prepared by adding, as an inorganic pigment, 180 g of alumina hydrate (trade name: Disperal HP14, manufactured by Sasol) to 1200 g of deionized water was stirred with a homomixer. The dispersion was continuously stirred, and 13.034 g of the suspension containing the composite compound was added thereto, followed by stirring for further 1 hour. The resulting dispersion was dried with a spray dryer to obtain alumina hydrate surface-treated with the composite compound containing magnesium, zirconium, and silicon. The drying was performed at a temperature (gas phase temperature) of 170° C.

Subsequently, 1.3 g of methanesulfonic acid and 100 g of the surface-treated alumina hydrate were added to 350 g of deionized water 350 g, followed by stirring with a homomixer. Deionized water and methanesulfonic acid were further added to the resulting dispersion to prepare pigment dispersion 2 having a pH of 4.2 and a solid content of 20% by mass.

An ink-jet recording medium having an ink-receiving layer containing alumina hydrate, PVA, and a composite compound containing magnesium, zirconium, and silicon was prepared as in Example 1 except that pigment dispersion 2 prepared above was used instead of pigment dispersion 1. The number ratio (Mg/Al) of atoms of magnesium (Mg) to that of aluminum (Al) in the ink-receiving layer was 0.003 when measured by inductively coupled plasma emission spectrometry (ICP-OES). The number ratio (Mg/Si) of atoms of magnesium (Mg) to that of silicon (Si) and the number ratio (Zr/Si) of atoms of zirconium (Zr) to that of silicon (Si) in the composite compound were both 1 when measured by inductively coupled plasma emission spectrometry (ICP-OES).

The pigment dispersion 2 was subjected XPS measurement to confirm that the positions of peaks in a 2p orbital spectrum and a 2s orbital spectrum of the aluminum atom constituting the alumina hydrate both shifted to the lower energy side compared with peak positions in the 2p orbital spectrum and the 2s orbital spectrum of the aluminum atom before the surface treatment. This result shows that the pigment contained in pigment dispersion 2 has been surface-treated with the composite compound.

Example 3

As a Group 2 or Group 3 element compound, 4.294 g of strontium acetate hemihydrate was added to 21 g of deionized water, and, as a zirconium compound, 4.506 g of zirconium oxyacetate was added thereto. The mixture was stirred with a homomixer (T.K. Robomix, manufactured by Primix Corp.) to prepare an aqueous solution containing strontium acetate hemihydrate and zirconium oxyacetate. Subsequently, as a silane coupling agent, 4.428 g of 3-aminopropyltriethoxysilane (trade name: KBE-903, manufactured by Shin-Etsu Chemical Co., Ltd.) was gradually added to the resulting aqueous solution. The silane coupling agent was hydrolyzed and condensed by stirring the resulting mixture for 5 hours to prepare a suspension of a composite compound containing strontium, zirconium, and silicon.

Separately, a dispersion prepared by adding 1.3 g of methanesulfonic acid and, as an inorganic pigment, 100 g of alumina hydrate (trade name: Disperal HP14, manufactured by Sasol) to 350 g of deionized water was stirred with a homomixer. The dispersion was continuously stirred, and 14.267 g of the suspension containing the composite compound was added to the dispersion while stirring. Deionized water and methanesulfonic acid were further added to the resulting dispersion to prepare pigment dispersion 3 having a pH of 4.2 and a solid content of 20% by mass.

An ink-jet recording medium having an ink-receiving layer containing alumina hydrate, PVA, and a composite compound containing strontium, zirconium, and silicon was prepared as in Example 1 except that pigment dispersion 3 prepared above was used instead of pigment dispersion 1. The number ratio (Sr/Al) of atoms of strontium (Sr) to that of aluminum (Al) in the ink-receiving layer was 0.005 when measured by inductively coupled plasma emission spectrometry (ICP-OES). The number ratio (Sr/Si) of atoms of strontium (Sr) to that of silicon (Si) and the number ratio (Zr/Si) of atoms of zirconium (Zr) to that of silicon (Si) in the composite compound were both 1 when measured by inductively coupled plasma emission spectrometry (ICP-OES).

Example 4

As a Group 2 or Group 3 element compound, 5.146 g of lanthanum acetate 1.5-hydrate was added to 30 g of deionized water, and, as a zirconium compound, 4.834 g of zirconium oxychloride octahydrate was added thereto. The mixture was stirred with a homomixer (T.K. Robomix, manufactured by Primix Corp.) to prepare an aqueous solution containing lanthanum acetate 1.5-hydrate and zirconium oxychloride octahydrate. Subsequently, as a silane coupling agent, 6.642 g of 3-aminopropyltriethoxysilane (trade name: KBE-903, manufactured by Shin-Etsu Chemical Co., Ltd.) was gradually added to the resulting aqueous solution. The silane coupling agent was hydrolyzed and condensed by stirring the resulting mixture for 5 hours to prepare a suspension of a composite compound containing lanthanum, zirconium, and silicon.

Separately, a dispersion prepared by adding 1.3 g of methanesulfonic acid and, as an inorganic pigment, 100 g of alumina hydrate (trade name: Disperal HP14, manufactured by Sasol) to 350 g of deionized water was stirred with a homomixer. The dispersion was continuously stirred, and 10.346 g of the suspension containing the composite compound was added to the dispersion while stirring. Deionized water and methanesulfonic acid were further added to the resulting dispersion to prepare pigment dispersion 4 having a pH of 4.2 and a solid content of 20% by mass.

An ink-jet recording medium having an ink-receiving layer containing alumina hydrate, PVA, and a composite compound containing lanthanum, zirconium, and silicon was prepared as in Example 1 except that pigment dispersion 4 prepared above was used instead of pigment dispersion 1. The number ratio (La/Al) of atoms of lanthanum (La) to that of aluminum (Al) in the ink-receiving layer was 0.002 when measured by inductively coupled plasma emission spectrometry (ICP-OES). The number ratio (La/Si) of atoms of lanthanum (La) to that of silicon (Si) and the number ratio (Zr/Si) of atoms of zirconium (Zr) to that of silicon (Si) in the composite compound were both 0.5 when measured by inductively coupled plasma emission spectrometry (ICP-OES).

Example 5

As a sol containing a Group 2 or Group 3 element compound, an yttrium oxide sol was used; and as a zirconium compound, zirconium oxychloride octahydrate was used. The yttrium oxide sol contains 10% by mass of yttrium oxide dispersed in deionized water, and the yttrium oxide contained in the sol has an average particle diameter of 100 nm when measured by a zeta-potential & particle size analyzer (ELSZ-2, manufactured by Otsuka Electronics Co., Ltd.). To 45.162 g of the yttrium oxide sol, 6.445 g of zirconium oxychloride octahydrate was added. To the resulting mixture, as a silane coupling agent, 3.928 g of 3-mercaptopropyltrimethoxysilane (trade name: KBM-803, manufactured by Shin-Etsu Chemical Co., Ltd.) was gradually added while mixing with a homomixer (T.K. Robomix, manufactured by Primix Corp.). The resulting mixture was further mixed for 5 hours to give a suspension including a composite compound containing yttrium, zirconium, and silicon.

Separately, a dispersion prepared by adding 1.3 g of methanesulfonic acid and, as an inorganic pigment, 100 g of alumina hydrate (trade name: Disperal HP14, manufactured by Sasol) to 350 g of deionized water was stirred with a homomixer. The dispersion was continuously stirred, and 46.295 g of the suspension containing the composite compound was added thereto while stirring. Deionized water and methanesulfonic acid were further added to the resulting dispersion to prepare pigment dispersion 5 having a pH of 4.2 and a solid content of 20% by mass.

An ink-jet recording medium having an ink-receiving layer containing alumina hydrate, PVA, and a composite compound containing yttrium, zirconium, and silicon was prepared as in Example 1 except that pigment dispersion 5 prepared above was used instead of pigment dispersion 1. The number ratio (Y/Al) of atoms of yttrium (Y) to that of aluminum (Al) in the ink-receiving layer was 0.01 when measured by inductively coupled plasma emission spectrometry (ICP-OES). The number ratio (Y/Si) of atoms of yttrium (Y) to that of silicon (Si) and the number ratio (Zr/Si) of atoms of zirconium (Zr) to that of silicon (Si) in the composite compound were both 1 when measured by inductively coupled plasma emission spectrometry (ICP-OES).

Example 6

A cerium oxide sol was used as the sol containing a Group 2 or Group 3 element compound, and zirconium oxychloride octahydrate was used as the zirconium compound. The cerium oxide sol contains 10% by mass of cerium oxide dispersed in deionized water, and the cerium oxide contained in the sol has an average particle diameter of 8 nm when measured by a zeta-potential & particle size analyzer (ELSZ-2, manufactured by Otsuka Electronics Co., Ltd.). To 68.844 g of the cerium oxide sol, 12.89 g of zirconium oxychloride octahydrate was added. To the resulting mixture, as a silane coupling agent, 9.452 g of 3-glycidoxypropyltrimethoxysilane (trade name: KBM-403, manufactured by Shin-Etsu Chemical Co., Ltd.) was gradually added while mixing with a homomixer (T.K. Robomix, manufactured by Primix Corp.). The resulting mixture was further mixed for 5 hours to give a suspension including a composite compound containing cerium, zirconium, and silicon.

Separately, a dispersion prepared by adding 1.3 g of methanesulfonic acid and, as an inorganic pigment, 100 g of alumina hydrate (trade name: Disperal HP14, manufactured by Sasol) to 320 g of deionized water was stirred with a homomixer. The dispersion was continuously stirred, and 76.014 g of the suspension containing the composite compound was added thereto while stirring. Deionized water and methanesulfonic acid were further added to the resulting dispersion to prepare pigment dispersion 6 having a pH of 4.2 and a solid content of 20% by mass.

An ink-jet recording medium having an ink-receiving layer containing alumina hydrate, PVA, and a composite compound containing cerium, zirconium, and silicon was prepared as in Example 1 except that pigment dispersion 6 prepared above was used instead of pigment dispersion 1. The number ratio (Ce/Al) of atoms of cerium (Ce) to that of aluminum (Al) in the ink-receiving layer was 0.02 when measured by inductively coupled plasma emission spectrometry (ICP-OES). The number ratio (Ce/Si) of atoms of cerium (Ce) to that of silicon (Si) and the number ratio (Zr/Si) of atoms of zirconium (Zr) to that of silicon (Si) in the composite compound were both 1 when measured by inductively coupled plasma emission spectrometry (ICP-OES).

Example 7

As a Group 2 or Group 3 element compound, 2.362 g of calcium nitrate tetrahydrate was added to 20 g of deionized water, and, as a zirconium compound, 2.253 g of zirconium oxyacetate was added thereto. The mixture was stirred with a homomixer (T.K. Robomix, manufactured by Primix Corp.) to prepare an aqueous solution containing calcium nitrate tetrahydrate and zirconium oxyacetate. Subsequently, as a silane coupling agent, 2.645 g of N-2-(aminoethyl)-3-aminopropyltriethoxysilane (trade name: KBE-603, manufactured by Shin-Etsu Chemical Co., Ltd.) was gradually added to the resulting aqueous solution. The silane coupling agent was hydrolyzed and condensed by stirring the resulting mixture for 5 hours to prepare a suspension of a composite compound containing calcium, zirconium, and silicon.

Separately, silica fine particle dispersion 1 was prepared by mixing the following materials with 250 g of deionized water using a planetary ball mill (trade name: P-6, manufactured by Fritsch GmbH) and zirconium beads of 5 mm diameter at 200 rpm for 5 min:

Inorganic pigment: 30 g of gas phase method silica (trade name: Aerosil 380, manufactured by Nippon Aerosil Co., Ltd.); and Cationic polymer: 1.2 g of dimethyldiallylammonium chloride homopolymer (trade name: Shallol DC902P, manufactured by Dai-ichi Kogyo Seiyaku Co., Ltd.).

To the resulting silica fine particle dispersion 1, 4.083 g of a suspension containing a composite compound was added. Deionized water was further added to the resulting mixture so as to have a solid content of 10% by mass, followed by mixing with a planetary ball mill (trade name: P-6, manufactured by Fritsch GmbH) and zirconium beads of 5 mm diameter at 200 rpm for 5 min to give pigment dispersion 7.

Separately, a PVA aqueous solution having a solid content of 8.0% by mass was prepared by dissolving polyvinyl alcohol PVA 235 (trade name, manufactured by Kuraray Co., Ltd., polymerization degree: 3500, saponification degree: 88%) in deionized water. The resulting PVA solution was mixed with pigment dispersion 7 so that the content of PVA was 20% by mass in terms of solid content based on the solid content of the gas phase method silica. Furthermore, an aqueous solution of 3.0% by mass of boric acid was mixed with the resulting solution so that the content of boric acid was 4.0% by mass in terms of solid content based on the solid content of the gas phase method silica to give a coating solution. The resulting coating solution was applied to one surface of a substrate, a PET film (trade name: Melinex 705, manufactured by Teijin DuPont Films Japan Limited) having a thickness of 100 μm, followed by drying at 110° C. to give an ink-jet recording medium having an ink-receiving layer containing silica; the composite compound containing calcium, zirconium, and silicon; and PVA. The amount of the ink-receiving layer applied was 30 g/m$^2$ in the dried state. The number ratio (Ca/Si) of atoms of calcium (Ca) to that of silica (Si) in the ink-receiving layer was 0.003 when measured by inductively coupled plasma emission spectrometry (ICP-OES). The number ratio (Ca/Si) of atoms of calcium (Ca) to that of silicon (Si) and the number ratio (Zr/Si) of atoms of zirconium (Zr) to that of silicon (Si) in the composite compound were both 1 when measured by inductively coupled plasma emission spectrometry (ICP-OES).

Comparative Example 1

A dispersion was prepared by adding 1.3 g of methanesulfonic acid and, as an inorganic pigment, 100 g of alumina hydrate (trade name: Disperal HP14, manufactured by Sasol) to 350 g of deionized water and mixing them with a homomixer. Deionized water and methanesulfonic acid were further added to the dispersion to prepare a pigment dispersion 8 having a pH of 4.2 and a solid content of 20% by mass.

An ink-jet recording medium having an ink-receiving layer not containing the composite compound containing a Group 2 or Group 3 element, zirconium, and silicon was prepared by the same procedure as in Example 1 except that pigment dispersion 8 prepared above was used instead of pigment dispersion 1.

Comparative Example 2

A dispersion was prepared by adding 1.3 g of methanesulfonic acid and, as an inorganic pigment, 100 g of alumina hydrate (trade name: Disperal HP14, manufactured by Sasol) to 350 g of deionized water and mixing them with a homomixer. As a silane coupling agent, 1.375 g of N-2-(aminoethyl)-3-aminopropyltriethoxysilane (trade name: KBE-603, manufactured by Shin-Etsu Chemical Co., Ltd.) was gradually added to the dispersion while stirring with the homomixer. The silane coupling agent was hydrolyzed and condensed by stirring the resulting solution for 5 hours. Subsequently, 1.057 g of magnesium chloride hexahydrate and 1.171 g of zirconium oxyacetate were further added to the solution, followed by stirring for 30 min. Furthermore, deionized water and methanesulfonic acid were added thereto to give pigment dispersion 9 having a pH of 4.2 and a solid content of 20% by mass. Pigment dispersion 9 contained an inorganic pigment, a hydrolysate or condensate of a silane coupling agent, a zirconium compound, and a magnesium compound, but did not contain a composite compound containing a Group 2 or Group 3 element, zirconium, and silicon.

Production of an ink-jet recording medium was tried by the same procedure as in Example 1 using pigment dispersion 9 prepared above instead of pigment dispersion 1. However, the viscosity of the resulting coating solution was considerably high, and coating was thereby difficult. That is, an ink-jet recording medium could not be prepared.

Comparative Example 3

As a zirconium compound, 4.506 g of zirconium oxyacetate was added to 14 g of deionized water, followed by mixing with a homomixer (T.K. Robomix, manufactured by Primix Corp.) to prepare an aqueous solution containing zirconium oxyacetate. Subsequently, as a silane coupling agent, 5.29 g of N-2-(aminoethyl)-3-aminopropyltriethoxysilane (trade name: KBE-603, manufactured by Shin-Etsu Chemical Co., Ltd.) was gradually added to the aqueous solution. The silane coupling agent was hydrolyzed and condensed by stirring the resulting mixture for 5 hours to prepare a suspension including a composite compound containing zirconium and silicon.

Separately, a dispersion prepared by adding 1.3 g of methanesulfonic acid and, as an inorganic pigment, 100 g of alumina hydrate (trade name: Disperal HP14, manufactured by Sasol) to 350 g of deionized water was stirred with a homomixer. The dispersion was continuously stirred, and 6.185 g of the suspension containing the composite compound was added thereto while stirring. Deionized water and methanesulfonic acid were further added to the resulting dispersion to prepare pigment dispersion 10 having a pH of 4.2 and a solid content of 20% by mass.

An ink-jet recording medium was prepared as in Example 1 except that pigment dispersion 10 prepared above was used instead of pigment dispersion 1. That is, an ink-jet recording medium having an ink-receiving layer that contained a composite compound containing zirconium and silicon but not containing a Group 2 or Group 3 element was prepared. The number ratio (Zr/Si) of atoms of zirconium (Zr) to that of silicon (Si) in the composite compound was 1 when measured by inductively coupled plasma emission spectrometry (ICP-OES).

Comparative Example 4

A suspension containing a composite compound containing zirconium and silicon was prepared as in Comparative Example 3.

Separately, a dispersion prepared by adding, 1.3 g of methanesulfonic acid and, as an inorganic pigment, 100 g of alumina hydrate (trade name: Disperal HP14, manufactured by Sasol) to 350 g of deionized water was stirred with a homomixer. The dispersion was continuously stirred, and 6.185 g of the suspension containing the composite compound was added thereto while stirring. Subsequently, 1.057 g of magnesium chloride hexahydrate was added thereto, followed by stirring for 30 min. Deionized water and methanesulfonic acid were further added to the resulting dispersion to prepare pigment dispersion 11 having a pH of 4.2 and a solid content of 20% by mass.

An ink-jet recording medium was prepared as in Example 1 except that pigment dispersion 11 prepared above was used instead of pigment dispersion 1. That is, an ink-jet recording medium having an ink-receiving layer that contained a composite compound containing zirconium and silicon but not containing a Group 2 or Group 3 element was prepared.

Comparative Example 5

Silica fine particle dispersion was prepared by mixing the following materials with 250 g of deionized water using a planetary ball mill (trade name: P-6, manufactured by Fritsch GmbH) and zirconium beads of 5 mm diameter at 200 rpm for 5 min:

Inorganic pigment: 30 g of gas phase method silica (trade name: Aerosil 380, manufactured by Nippon Aerosil Co., Ltd.); and Cationic polymer: 1.2 g of dimethyldiallylammonium chloride homopolymer (trade name: Shallol DC902P, manufactured by Dai-ichi Kogyo Seiyaku Co., Ltd.).

Deionized water was added to the silica fine particle dispersion prepared above so as to have a solid content of 10% by mass to give pigment dispersion 12. An ink-jet recording medium was prepared as in Example 7 except that pigment dispersion 12 was used instead of pigment dispersion 7. That is, an ink-jet recording medium having an ink-receiving layer that did not contain the composite compound containing a Group 2 or Group 3 element, zirconium, and silicon.

Evaluation of Ink-Jet Recording Medium

The ink-jet recording media prepared in Examples 1 to 7 and Comparative Examples 1 and 3 to 5 were evaluated for ozone resistance and blurring in images stored under a high temperature and high humidity environment.

1) Ozone Resistance

Preparation of Images for Ozone Resistance Evaluation

An image was formed by recording black, cyan, magenta, and yellow monochromatic patches (each 2.5 cm×2.5 cm) on the recording surface of each of the ink-jet recording media produced in Examples 1 to 7 and Comparative Examples 1 and 3 to 5 so as to have an optical density (OD) of 1.0. The recording was performed with a printer for photographs (trade name: PIXUS iP4600, ink: BCI-321, both manufactured by CANON KABUSHIKI KAISHA) using an ink-jet system.

Ozone Resistance Test

Each image formed above was subjected to an ozone exposure test using an Ozone Weather-Ometer (model: OMS-HS, manufactured by Suga Test Instruments Co., Ltd.). The test conditions were as follows:

Exposure gas composition: 2.5 volume ppm of ozone,

Test time: 80 hours, and

Temperature and humidity conditions in test tank: 23° C. and 50% RH (relative humidity).

Method of Evaluating Ozone Resistance

Each image was measured for image densities before and after the test with a spectrophotometer (trade name: Spectrolino, manufactured by GretagMacbeth), and each optical density residual rate was calculated by the following expression:

Optical density residual rate(%)=[(optical density after test)/(optical density before test)]×100.

The ozone resistance of each image was evaluated using the resulting optical density residual rate and the following evaluation criteria:

A: cyan density residual rate was 90% or more;

B: cyan density residual rate was 85% or more and less than 90%; and

C: cyan density residual rate was less than 85%.

In the present invention, an image evaluated as the criterion A in the evaluation criteria above was determined to have sufficient ozone resistance. Table 1 shows the results.

2) Blurring in Image Stored Under High Temperature and High Humidity Environment Storage Test of Image Under High Temperature and High Humidity Environment An image was formed by recording a black patch of (R,G,B)=(0,0,0) on the recording surface of each of the ink-jet recording media produced in Examples 1 to 7 and Comparative Examples 1 and 3 to 5 with a printer for photographs (trade name: PIXUS iP4600, ink: BCI-321, both manufactured by CANON KABUSHIKI KAISHA) using an ink-jet system. The resulting images were left to stand under an environment of a temperature of 23° C. and a relative humidity of 50% for 24 hours and were then stored under an environment of a temperature of 25° C. and a relative humidity of 85% for 4 weeks. The images after the storage test were each visually inspected for ink blurring on the periphery of the black patch. Blurring of the image was evaluated by the following evaluation criteria:

A: blurring was hardly visually recognized;

B: blurring was slightly visually recognized; and

C: blurring was recognized.

In the present invention, an image evaluated as the criterion A or B in the evaluation criteria was determined that the image was sufficiently prevented from blurring. Table 1 shows the results.

TABLE 1

| | | Composite Compound | | | Metal compound | | Blurring in image stored under a high |
|---|---|---|---|---|---|---|---|
| | Inorganic pigment | Group 2 or 3 element compound | Zirconium compound | Silane coupling agent | added to pigment dispersant | Ozone resistance of image | temperature and high humidity environment |
| Ex. 1 | Alumina hydrate | $MgCl_2 \cdot 6H_2O$ | $ZrO(CH_3COO)_2$ | N-2-(Aminoethyl)-3-aminopropyltriethoxysilane | — | A | B |
| Ex. 2 | Alumina hydrate | $MgCl_2 \cdot 6H_2O$ | $ZrO(CH_3COO)_2$ | N-2-(Aminoethyl)-3-aminopropyltriethoxysilane | — | A | A |
| Ex. 3 | Alumina hydrate | $Sr(CH_3COO)_2 \cdot 0.5H_2O$ | $ZrO(CH_3COO)_2$ | 3-Aminopropyltriethoxysilane | — | A | B |
| Ex. 4 | Alumina hydrate | $La(CH_3COO)_2 \cdot 1.5H_2O$ | $ZrOCl_2 \cdot 8H_2O$ | 3-Aminopropyltriethoxysilane | — | A | B |
| Ex. 5 | Alumina hydrate | $Y_2O_3$ | $ZrOCl_2 \cdot 8H_2O$ | 3-Mercaptopropyltrimethoxysilane | — | A | B |
| Ex. 6 | Alumina hydrate | $CeO_2$ | $ZrOCl_2 \cdot 8H_2O$ | 3-Glycidoxypropyltrimethoxysilane | — | A | B |
| Ex. 7 | Gas-phase method silica | $Ca(NO_3)_2 \cdot 4H_2O$ | $ZrO(CH_3COO)_2$ | N-2-(Aminoethyl)-3-aminopropyltriethoxysilane | — | A | B |
| Comp. Ex. 1 | Alumina hydrate | — | — | — | — | C | B |
| Comp. Ex. 3 | Alumina hydrate | — | $ZrO(CH_3COO)_2$ | N-2-(Aminoethyl)-3-aminopropyltriethoxysilane | — | B | B |
| Comp. Ex. 4 | Alumina hydrate | — | $ZrO(CH_3COO)_2$ | N-2-(Aminoethyl)-3-aminopropyltriethoxysilane | $MgCl_2 \cdot 6H_2O$ | A | C |
| Comp. Ex. 5 | Gas-phase method silica | — | — | — | — | C | B |

Examples 8 to 12 and Comparative Examples 6 to 11

Preparation of Composite Compound Dispersion A

An aqueous solution containing a silane coupling agent was prepared by dropwise adding, as the silane coupling agent, 4.45 g of N-2-(aminoethyl)-3-aminopropyltrimethoxysilane (trade name: KBM-603, manufactured by Shin-Etsu Chemical Co., Ltd.) to 15 g of deionized water while mixing with a homomixer (T.K. Robomix, manufactured by Primix Corp.). To the resulting aqueous solution, an aqueous solution prepared by dissolving 4.07 g of magnesium chloride ($MgCl_2$) in 15 g of deionized water was dropwise added, followed by stirring for 5 hours to give a dispersion containing a composite compound come from the silane coupling agent and magnesium chloride. An aqueous solution prepared by dissolving 4.51 g of zirconium oxyacetate ($ZrO(CH_3COO)_2$) in 15 g of deionized water was further added to the resulting dispersion, followed by stirring 5 hours to give composite compound dispersion A containing a composite compound having silicon, magnesium, and zirconium in the structure thereof.

A part of composite compound dispersion A was dried at 110° C. The resulting solid was pulverized in a mortar to obtain powder containing the composite compound. The resulting powder was subjected to X-ray diffraction (XRD) measurement. No diffraction peaks of a magnesium salt and a zirconium salt such as magnesium chloride hexahydrate and zirconium oxyacetate used as the raw materials were detected in the resulting XRD chart. Instead, broad peaks were observed at 27°, 40°, and 57°. This indicates that a composite compound having an amorphous structure containing magnesium, zirconium, and silicon therein was prepared. The XRD measurement was performed with an X-ray diffraction apparatus (D8 ADVANCE, manufactured by Bruker AXS K.K.) using a Cu-Kα ray. The diffraction pattern was obtained by continuous scanning, i.e., taking data at 2θ=10° to 80°, a sweep rate of 2°/min, and recording at each 2θ=0.02°.

Preparation of Composite Compound Dispersion B

An aqueous solution containing a silane coupling agent was prepared by dropwise adding, as the silane coupling agent, 4.45 g of N-2-(aminoethyl)-3-aminopropyltrimethoxysilane to 15 g of deionized water while mixing with a homomixer. To the resulting aqueous solution, an aqueous solution prepared by dissolving 4.51 g of zirconium oxyacetate in 15 g of deionized water was dropwise added, followed by stirring for 5 hours to give a dispersion containing a composite compound come from the silane coupling agent and zirconium oxyacetate. An aqueous solution prepared by dissolving 4.07 g of magnesium chloride in 15 g of deionized water was further added to the resulting dispersion, followed by stirring 5 hours to give composite compound dispersion B containing a composite compound having silicon, magnesium, and zirconium in the structure thereof. The composite compound in the composite compound dispersion B was subjected to X-ray diffraction measurement as in composite compound dispersion A to confirm that the composite compound had an amorphous structure containing magnesium, zirconium, and silicon therein.

Preparation of Composite Compound Dispersion C

An aqueous solution containing magnesium chloride and zirconium oxyacetate was prepared by adding 4.07 g of magnesium chloride to 30 g of deionized water while mixing with a homomixer and then further adding 4.51 g of zirconium oxyacetate thereto. To the resulting aqueous solution, an aqueous solution prepared by dissolving, as a silane coupling agent, 4.45 g of N-2-(aminoethyl)-3-aminopropyltrimethoxysilane in 15 g of deionized water was dropwise added, followed by stirring for 5 hours to give composite compound dispersion C containing a composite compound containing silicon, magnesium, and zirconium in the structure thereof. The composite compound in the composite compound dispersion C was subjected to X-ray diffraction measurement as in composite compound dispersion A to confirm that the composite compound had an amorphous structure containing magnesium, zirconium, and silicon therein.

Preparation of Composite Compound Dispersion D

An aqueous solution containing a silane coupling agent was prepared by dropwise adding, as the silane coupling agent, 4.45 g of N-2-(aminoethyl)-3-aminopropyltrimethoxysilane to 15 g of deionized water while mixing with a homomixer. To the resulting aqueous solution, an aqueous solution prepared by dissolving 4.07 g of magnesium chloride ($MgCl_2$) in 15 g of deionized water was dropwise added, followed by stirring for 5 hours to give composite compound dispersion D containing a composite compound having silicon and magnesium in the structure thereof.

Preparation of Composite Compound Dispersion E

An aqueous solution containing a silane coupling agent was prepared by dropwise adding, as the silane coupling agent, 4.45 g of N-2-(aminoethyl)-3-aminopropyltrimethoxysilane to 15 g of deionized water while mixing with a homomixer. To the resulting aqueous solution, an aqueous solution prepared by dissolving 4.51 g of zirconium oxyacetate in 15 g of deionized water was dropwise added, followed by stirring for 5 hours to give composite compound dispersion E containing a composite compound having silicon and zirconium in the structure thereof.

Preparation of Composite Compound Dispersion F

An aqueous solution containing a silane coupling agent was prepared by dropwise adding, as the silane coupling agent, 6.64 g of 3-aminopropyltriethoxysilane (trade name: KBE-903, manufactured by Shin-Etsu Chemical Co., Ltd.) to 15 g of deionized water while stirring with a homomixer (T.K. Robomix, manufactured by Primix Corp.). To the resulting aqueous solution, an aqueous solution prepared by dissolving 5.15 g of lanthanum acetate 1.5-hydrate ($La(CH_3COO)_3.1.5H_2O$) in 15 g of deionized water was dropwise added, followed by stirring for 5 hours to give a dispersion containing a composite compound come from the silane coupling agent and lanthanum acetate. An aqueous solution prepared by dissolving 4.83 g of zirconium oxychloride octahydrate ($ZrOCl_2.8H_2O$) in 15 g of deionized water was further added to the resulting dispersion, followed by stirring for 5 hours to give composite compound dispersion F containing a composite compound having silicon, lanthanum, and zirconium in the structure thereof. The composite compound in the composite compound dispersion F was subjected to X-ray diffraction measurement as in composite compound dispersion A to confirm that the composite compound had an amorphous structure containing lanthanum, zirconium, and silicon therein.

Preparation of Composite Compound Dispersion G

An aqueous solution containing a silane coupling agent was prepared by dropwise adding, as the silane coupling agent, 2.645 g of N-2-(aminoethyl)-3-aminopropyltriethoxysilane (trade name: KBE-603, manufactured by Shin-Etsu Chemical Co., Ltd.) to 15 g of deionized water while stirring with a homomixer. To the resulting aqueous solution, an aqueous solution prepared by dissolving 2.253 g of zirconium oxyacetate in 15 g of deionized water was dropwise added, followed by stirring for 5 hours to give a dispersion containing a composite compound come from the silane coupling agent and zirconium oxyacetate. An aqueous solution prepared by dissolving 2.36 g of calcium nitrate tetrahydrate ($Ca(NO_3)_2.4H_2O$) in 15 g of deionized water was further added to the resulting dispersion, followed by stirring for 5 hours to give composite compound dispersion G containing a composite compound having silicon, calcium, and zirconium in the structure thereof. The composite compound in the composite compound dispersion G was subjected to X-ray diffraction measurement as in composite compound dispersion A to confirm that the composite compound had an amorphous structure containing calcium, zirconium, and silicon therein.

Preparation of Metal Compound Aqueous Solution (a)

Metal compound aqueous solution (a) was prepared by adding 4.51 g of zirconium oxyacetate to 15 g of deionized water while mixing with a homomixer.

Preparation of Metal Compound Aqueous Solution (b)

Metal compound aqueous solution (b) was prepared by adding 4.07 g of magnesium chloride to 15 g of deionized water while mixing with a homomixer.

Example 8

To 220 g of deionized water, 1.2 g of glacial acetic acid and, as an inorganic pigment, 60 g of alumina hydrate (trade name: Disperal HP14, manufactured by Sasol) were added. To the resulting mixture, 8.7 g of composite compound dispersion A was added while stirring with a homomixer. Subsequently, deionized water and glacial acetic acid were further added thereto to give a pigment dispersion having a pH of 4.5 and an alumina solid content of 16% by mass. Separately, as a binder, polyvinyl alcohol PVA 235 (trade name, manufactured by Kuraray Co., Ltd., viscosity average polymerization degree: 3500, saponification degree: 88%) was dissolved in deionized water to give a PVA aqueous solution having a solid content of 8.0% by mass.

The PVA aqueous solution was mixed with the pigment dispersion prepared by the above-described procedure so that the content of PVA was 10% by mass in terms of solid content based on the solid content (100% by mass) of alumina hydrate. Furthermore, an aqueous solution of 3.0% by mass of boric acid was added to the resulting solution so that the content of boric acid was 1.5% by mass in terms of solid content based on the solid content (100% by mass) of alumina hydrate to give a coating solution. The resulting coating solution was applied to one surface of a substrate, a polyethylene terephthalate (PET) film (trade name: Melinex 705, manufactured by Teijin DuPont Films Japan Limited) having a thickness of 100 μm, followed by drying at 110° C. for 10 min to give ink-jet recording medium 1. The amount of the ink-receiving layer applied was 35 g/m$^2$ in the dried state.

Example 9

Ink-jet recording medium 2 was prepared by the same procedure as in Example 8 except that composite compound dispersion B was used instead of composite compound dispersion A.

Example 10

Ink-jet recording medium 3 was prepared by the same procedure as in Example 8 except that composite compound dispersion C was used instead of composite compound dispersion A.

Comparative Example 6

Ink-jet recording medium 4 was prepared by the same procedure as in Example 8 except that 5.78 g of composite compound dispersion A and 5.84 g of composite compound dispersion E were used instead of 8.7 g of composite compound dispersion A.

Comparative Example 7

Ink-jet recording medium 5 was prepared by the same procedure as in Example 8 except that 5.78 g of composite compound dispersion D and 2.93 g of metal compound aqueous solution (a) were used instead of 8.7 g of composite compound dispersion A.

Comparative Example 8

Ink-jet recording medium 6 was prepared by the same procedure as in Example 8 except that 5.84 g of composite compound dispersion E and 2.86 g of metal compound aqueous solution (b) were used instead of 8.7 g of composite compound dispersion A.

Comparative Example 9

Ink-jet recording medium 7 was prepared by the same procedure as in Example 8 except that 5.78 g of composite compound dispersion D was used instead of 8.7 g of composite compound dispersion A.

Comparative Example 10

Ink-jet recording medium 8 was prepared by the same procedure as in Example 8 except that 5.84 g of composite compound dispersion E was used instead of 8.7 g of composite compound dispersion A.

Comparative Example 11

Ink-jet recording medium 9 was prepared by the same procedure as in Example 8 except that composite compound dispersion A was not added.

Example 11

Ink-jet recording medium 10 was prepared by the same procedure as in Example 8 except that composite compound dispersion F was used instead of composite compound dispersion A.

Example 12

Silica fine particle dispersion was prepared by mixing the following materials with 250 g of deionized water using a planetary ball mill (trade name: P-6, manufactured by Fritsch GmbH) and zirconium beads of 5 mm diameter at 200 rpm for 5 min:

Inorganic pigment: 30 g of gas phase method silica (trade name: Aerosil 380, manufactured by Nippon Aerosil Co., Ltd.); and Cationic polymer: 1.2 g of dimethyldiallylammonium chloride homopolymer (trade name: Shallol DC902P, manufactured by Dai-ichi Kogyo Seiyaku Co., Ltd.).

To the resulting silica fine particle dispersion, 4.08 g of composite compound dispersion G was added while stirring with a homomixer. Deionized water was further added thereto to adjust the solid content to 10% by mass, followed by mixing with a planetary ball mill (trade name: P-6, manufactured by Fritsch GmbH) and zirconium beads of 5 mm diameter at 200 rpm for 5 min to give a pigment dispersion. Separately, as a binder, polyvinyl alcohol PVA 235 (trade name, manufactured by Kuraray Co., Ltd., viscosity average polymerization degree: 3500, saponification degree: 88%) was dissolved in deionized water to give a PVA aqueous solution having a solid content of 8.0% by mass.

The PVA aqueous solution was mixed with the pigment dispersion prepared by the above-described procedure so that the solid content of PVA was 20% by mass in terms of solid content based on the solid content (100% by mass) of the gas phase method silica. Furthermore, an aqueous solution of 3.0% by mass of boric acid was added to the resulting solution so that the content of boric acid was 4.0% by mass in terms of solid content based on the solid content (100% by mass) of the gas phase method silica to give a coating solution. The resulting coating solution was applied to one surface of a substrate, a polyethylene terephthalate (PET) film (trade name: Melinex 705, manufactured by Teijin DuPont Films Japan Limited) having a thickness of 100 μm, followed by drying at 110° C. for 10 min to give ink-jet recording medium 11. The amount of the ink-receiving layer applied was 30 g/m$^2$ in the dried state.

Table 2 summarizes compositions of ink-jet recording media 1 to 11. In Table 2, "+" means forming a composite, and "( )" means that the elements in parentheses form a composite prior to formation of a composite with the element outside the parentheses. Specifically, (Zr+Si)+Mg of Example 8 shows a procedure of forming a composite compound including zirconium, silicon, and magnesium in the structure thereof by subjecting a zirconium compound and a silane coupling agent to a compound reaction to form a composite and then adding a magnesium compound to the resulting composite.

TABLE 2

| | | Composite compound contained in pigment dispersion | | | |
|---|---|---|---|---|---|
| | Recording medium | Composite Compound 1 | Composition of composite compound 1 | Composite Compound 2 | Composition of composite compound 2 |
| Ex. 8 | Recording medium 1 | Composite Compound A | (Zr + Si) + Mg | — | — |
| Ex. 9 | Recording medium 2 | Composite Compound B | (Mg + Si) + Zr | — | — |
| Ex. 10 | Recording medium 3 | Composite Compound C | (Zr + Mg) + Si | — | — |
| Comp. Ex. 6 | Recording medium 4 | Composite Compound D | Mg + Si | Composite Compound E | Zr + Si |
| Comp. Ex. 7 | Recording medium 5 | Composite Compound D | Mg + Si | Metal compound a | Zr |
| Comp. Ex. 8 | Recording medium 6 | Composite Compound E | Zr + Si | Metal compound b | Mg |
| Comp. Ex. 9 | Recording medium 7 | Composite Compound D | Mg + Si | — | — |
| Comp. Ex. 10 | Recording medium 8 | Composite Compound E | Zr + Si | — | — |
| Comp. Ex. 11 | Recording medium 9 | — | — | — | — |
| Ex. 11 | Recording medium 10 | Composite Compound F | (La + Si) + Zr | — | — |
| Ex. 12 | Recording medium 11 | Composite Compound G | (Zr + Si) + Ca | — | — |

Evaluation of Ink-Jet Recording Medium

Ozone resistance of images, blurring of images stored under a high temperature and high humidity environment, and light resistance of images were evaluated using ink-jet recording media 1 to 11. The evaluation of ozone resistance of images and blurring of images were performed as in Examples 1 to 7 and Comparative Examples 1 to 5 described above.

Evaluation of Light Resistance of Image

Black, cyan, magenta, and yellow monochromatic patches were formed on ink-jet recording media 1 to 9 as in the method of forming images for evaluating ozone resistance of images. The resulting images were subjected to a light exposure test using a Xenon Weather-Ometer (model: Ci4000, manufactured by Atlas Electric Devices Corp.). The test conditions were as follows:

Irradiation illuminance: 0.39 W/m$^2$ (wavelength: 340 nm),

Test time: 100 hours, and

Temperature and humidity conditions in test tank: 50° C. and 70% RH (relative humidity).

Each image was measured for image densities before and after the light exposure test with a spectrophotometer (trade name: Spectrolino, manufactured by GretagMacbeth), and the optical density residual rate was calculated by the following expression:

$$\text{Optical density residual rate}(\%)=[(\text{Optical density after test})/(\text{optical density before test})]\times 100.$$

The light resistance of each image was evaluated using the resulting optical density residual rate and the following evaluation criteria:

A: magenta density residual rate was 80% or more;

B: magenta density residual rate was 75% or more and less than 80%; and

C: magenta density residual rate was less than 75%.

Table 3 shows the results.

TABLE 3

| | Recording medium | Ozone resistance of image | Blurring in image stored under a high temperature and high humidity environment | Light resistance of image | Notes |
|---|---|---|---|---|---|
| Ex. 8 | Recording medium 1 | A | B | A | — |
| Ex. 9 | Recording medium 2 | A | B | A | — |
| Ex. 10 | Recording medium 3 | A | B | B | — |
| Comp. Ex. 6 | Recording medium 4 | A | C | B | — |
| Comp. Ex. 7 | Recording medium 5 | — | — | — | Application of coating solution was impossible because of increased viscosity |
| Comp. Ex. 8 | Recording medium 6 | A | C | B | — |
| Comp. Ex. 9 | Recording medium 7 | A | C | B | — |
| Comp. Ex. 10 | Recording medium 8 | B | B | C | — |
| Comp. Ex. 11 | Recording medium 9 | C | B | B | — |
| Ex. 11 | Recording medium 10 | A | B | A | — |
| Ex. 12 | Recording medium 11 | A | B | A | — |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-149275 filed Jul. 5, 2011 and No. 2011-149362 filed Jul. 5, 2011, which are hereby incorporated by reference herein in their entirety.

What is claimed is:

1. A recording medium comprising an ink-receiving layer containing an inorganic pigment and a binder on at least one surface of a substrate, wherein the ink-receiving layer contains a compound including zirconium, silicon, and at least one element selected from Group 2 and Group 3 elements of the periodic table.

2. The recording medium according to claim 1, wherein the compound includes a siloxane bond via the at least one element selected from Group 2 and Group 3 elements of the periodic table and the zirconium.

3. The recording medium according to claim 1, wherein the compound includes a —Si—O-M-O—Si— structure, where M represents the at least one element selected from Group 2 and Group 3 elements of the periodic table, and a —Si—O—Zr—O—Si— structure.

4. The recording medium according to claim 1, wherein the number of atoms of the Group 2 or Group 3 element of the periodic table contained in the compound is 0.1 times or more and 5 times or less the number of the silicon atoms.

5. The recording medium according to claim 1, wherein the number of the zirconium atoms contained in the compound is 0.1 times or more and 5 times or less the number of the silicon atoms.

6. The recording medium according to claim 1, wherein the compound is prepared by adding a compound containing at least one element selected from Group 2 and Group 3 elements of the periodic table, a compound containing zirconium, and a silane coupling agent to a liquid solvent containing at least one of water and alcohol and then hydrolyzing or condensing the silane coupling agent contained in the liquid solvent.

7. The recording medium according to claim 1, wherein the compound is prepared by forming a precursor through formation of a composite of one of a compound containing at least one element selected from Group 2 and Group 3 elements of the periodic table and a compound containing zirconium with a silane coupling agent in a liquid solvent containing at least one of water and alcohol; and forming a composite of the other of the compound containing at least one element selected from Group 2 and Group 3 elements of the periodic table and the compound containing zirconium with the precursor.

8. The recording medium according to claim 7, wherein the compound containing at least one element selected from Group 2 and Group 3 elements of the periodic table is at least one selected from the group consisting of salts each composed of an ion of the at least one element selected from Group 2 and Group 3 elements of the periodic table and an organic acid ion or an inorganic ion, hydrates of the salts, and oxides of the at least one element selected from Group 2 and Group 3 elements of the periodic table.

9. The recording medium according to claim 7, wherein the compound containing zirconium is at least one selected from the group consisting of halide salts of zirconium, oxoacid salts of zirconium, and organic acid salts of zirconium.

10. The recording medium according to claim 1, wherein the inorganic pigment is at least one selected from the group consisting of alumina hydrate and silica.

11. The recording medium according to claim 1, wherein the inorganic pigment is surface-treated with the compound.

12. The recording medium according to claim 11, wherein the surface-treated inorganic pigment is prepared by drying a dispersion containing the inorganic pigment and the compound by heating at 100° C. or more and 400° C. or less.

13. The recording medium according to claim 1, wherein the at least one element selected from Group 2 and Group 3 elements of the periodic table is at least one selected from magnesium, calcium, strontium, yttrium, lanthanum, and cerium.

14. The recording medium according to claim 1, wherein the content of the compound is 0.1% by mass or more and 30% by mass or less based on the total mass of the inorganic pigment.

* * * * *